United States Patent [19]

Cobble

[11] 4,069,776

[45] Jan. 24, 1978

[54] KNIFE BLOCK FOR CUT PILE TUFTING MACHINE

[75] Inventor: Paul M. Cobble, Chattanooga, Tenn.

[73] Assignee: B & J Machinery Company, Inc., Dalton, Ga.

[21] Appl. No.: 716,955

[22] Filed: Aug. 23, 1976

[51] Int. Cl.[2] ..... D05C 15/24

[52] U.S. Cl. ..... 112/79 R

[58] Field of Search ..... 112/79 R, 79 A, 79 FF, 112/78, 79.5, 266, 410, 411; 83/700

[56] References Cited

U.S. PATENT DOCUMENTS

| | | | |
|---|---|---|---|
| 3,277,852 | 10/1966 | Card | 112/79 R |
| 3,604,379 | 9/1971 | Cobble | 112/79 R |
| 3,757,709 | 9/1973 | Cobble | 112/79 R |
| 3,788,245 | 1/1974 | Bonner, Sr. | 112/79 R |
| 3,820,482 | 6/1974 | Woodcock | 112/79 A |

*Primary Examiner*—H. Hampton Hunter

*Attorney, Agent, or Firm*—Bell, Seltzer, Park & Gibson

[57] ABSTRACT

A knife block for a high-low cut pile tufting machine and which comprises a pair of laterally spaced apart and longitudinally extending channels in each of the side faces of the block. Each channel is adapted to securely mount a knife blade therein such that the pair of blades on each side of the block are aligned in the machine direction and are adapted to be independently removed, sharpened, and replaced.

12 Claims, 4 Drawing Figures

KNIFE BLOCK FOR CUT PILE TUFTING MACHINE

The present invention relates to a knife block for a tufting machine and more particularly, to a knife block adapted to independently mount two pairs of knives, with each pair being aligned in the machine direction and adapted to operatively engage a looper of the type used in the fabrication of high-low cut pile tufted fabrics.

Cut pile tufting machines have recently been developed which are able to achieve a high-low pattern effect by feeding pre-selected lengths of yarn to each of the individual needles upon each reciprocation of the needle bar. More particularly, such tufting machines include loopers having upper and lower bills which face in a direction opposite the direction of travel of the backing fabric, and with both bills entering the yarn loops formed by the reciprocating needles. The yarn pattern control mechanism pulls the yarn from the lower bill onto the upper bill when the pattern control indicates that a low tuft is to be formed, and a pair of knives cooperate with the looper to sever the loops positioned on each of the bills. In one such prior machine, the pair of knives are aligned in the machine direction and are mounted in a holding block having a relatively wide slot therein. The knives are disposed in contiguous, side-by-side relation in the slot, and held therein by a single clamp.

The above knife mounting structure is unsatisfactory in several respects, including the fact that the two knives for each looper must be concurrently mounted in the block, which renders the mounting and height alignment of the knives difficult. Further, both knives must be removed when either one needs to be sharpened or otherwise replaced, which increases the frequency of the concurrent mounting of the two knives. Also, it is difficult to hold the two knives securely in the slot, and the knives tend to bow out of alignment as they are clamped together. As still another disadvantage, the fact that the knives are in contact along their length limits the free flexure of each knife, which often interferes with a proper cutting action.

It is accordingly an object of the present invention to provide a knife block for a high-low cut pile tufting machine which overcomes the above noted difficulties of the prior devices.

It is another more particular object of the present invention to provide a knife block which is adapted to mount a pair of knives which are aligned in the machine direction, and with the two aligned knives being independently secured to the block to permit independent removal and replacement thereof.

It is another object of the present invention to provide a knife block of the described type wherein the knives are mounted in laterally spaced apart separate channels to securely maintain the alignment thereof and permit independent flexure of the knives to thereby assure proper cutting action.

These and other objects and advantages of the present invention are achieved in the embodiment illustrated herein by the provision of a knife block which comprises a solid body member having a pair of laterally spaced apart and longitudinally directed channels in at least one of the two side faces thereof, and with each channel extending at least a substantial portion of the longitudinal length of the body member and communicating with at least one of the ends thereof. Means are provided for independently securing a knife in each of the channels, and in the preferred embodiment, this securing means comprises a slot extending laterally into each of the opposite edge faces of the body member, with the slot communicating with the adjacent channel, and a clamping member adapted to extend laterally into each slot to engage a knife positioned therein.

Some of the objects of the invention having been stated, other objects will appear as the description proceeds, when taken in connection with the accompanying drawings, in which.

Figure 1:
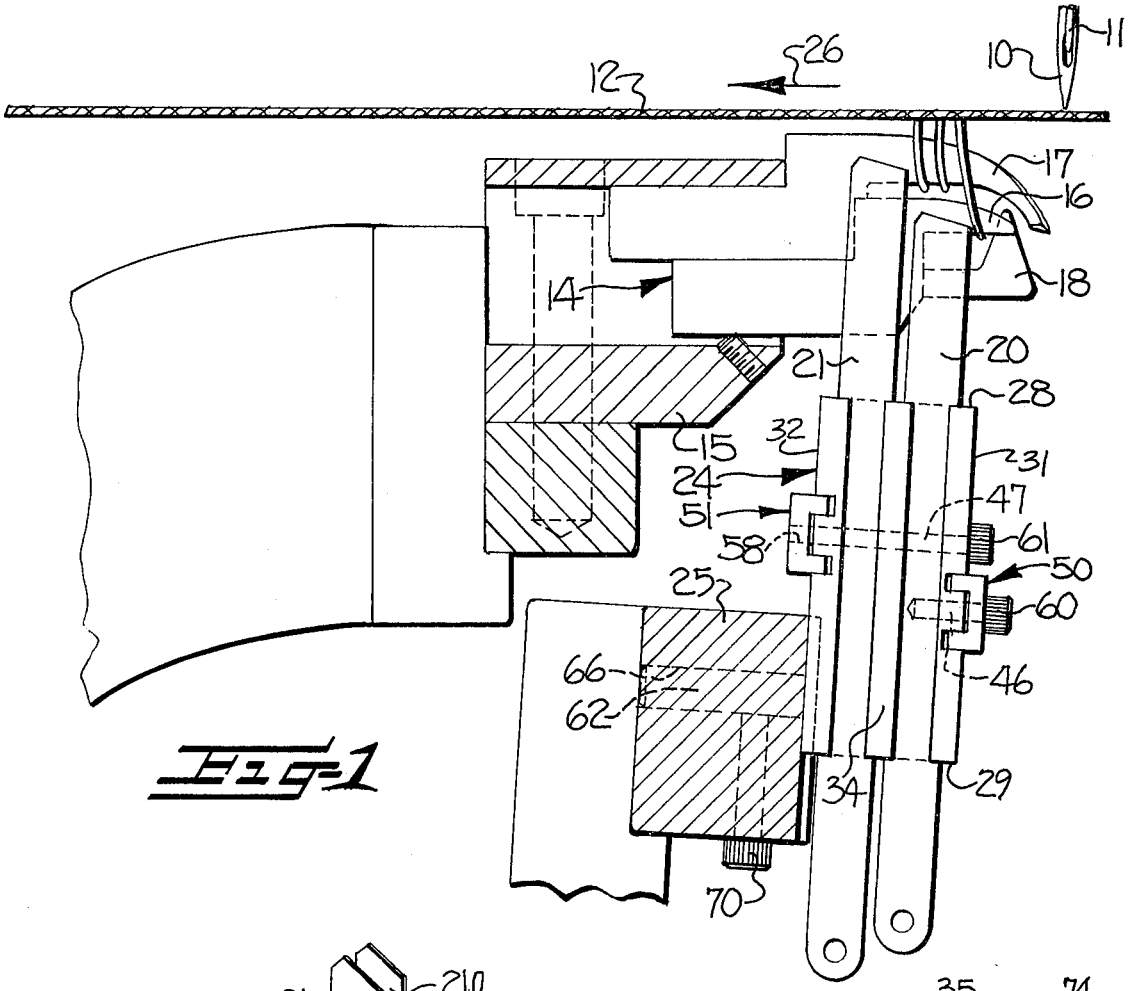
FIG. 1 is a fragmentary, partly sectioned view of a portion of a cut pile tufting apparatus and including a knife block which embodies the present invention.
Figure 2:
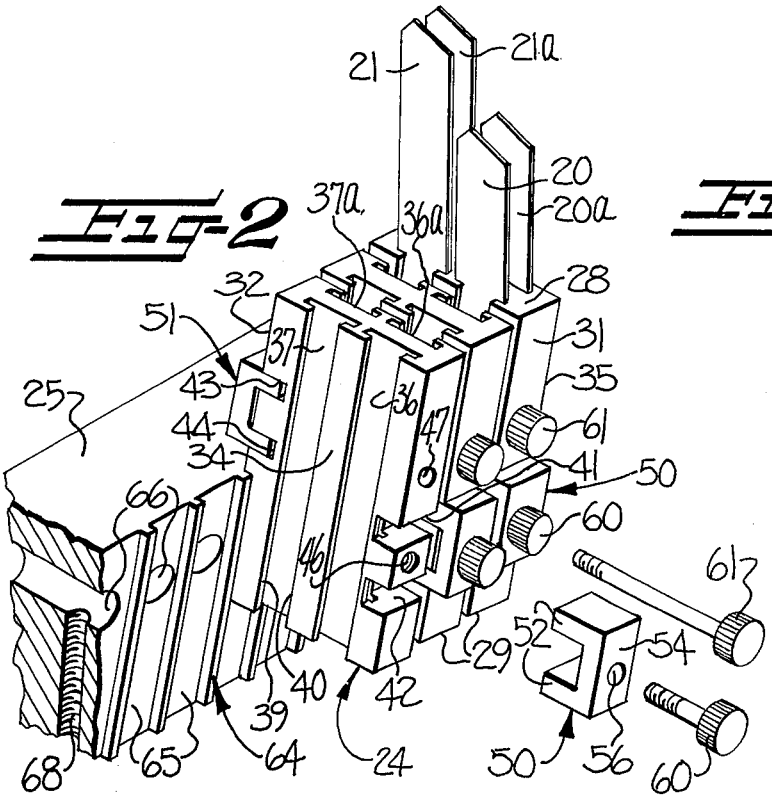
FIG. 2 is a fragmentary perspective view, illustrating the knife bar and knife blocks shown in FIG. 1.

Referring more specifically to the drawings, FIG. 1 illustrates a loop severing mechanism in an otherwise conventional cut pile tufting machine. As illustrated, the loop severing mechanism includes a plurality of reciprocating needles 10, each of which carries a yarn 11 through an advancing backing fabric 12 to form a row of tufting loops therein. A plurality of loopers 14 are secured to a looper bar 15 such that each looper 14 is operatively associated with one of the needles 10 to engage and retain the tufting yarn loops. Each looper 14 comprises lower and upper bills 16 and 17, respectively, which extend in a direction opposite the direction of movement of the fabric backing, and a laterally flexible clip 18 is carried by the lower bill for the purposes set forth below.

A pair of cutting knives 20, 21 is operatively associated with each looper, with the knives being aligned in the machine direction and mounted for oscillatory movement in relation to the looper 14 to sever the yarn loops held on each of the two bills thereof. The knives 20, 21 are mounted in the knife block 24 which embodies the present invention and as hereinafter more specifically described, with the knife 20 being operatively associated with the bill 16 and the knife 21 being operatively associated with the bill 17. The block 24 is in turn mounted on the knife bar 25 in a predetermined angular relationship with respect to the bar such that each knife properly engages the associated looper bill and severs the yarn carried thereon in a scissors-like oscillating movement.

In operation, the needles 10 are reciprocated through the advancing backing fabric 12, and both bills 16 and 17 of each looper 14 enter the loop of the yarn formed by the associated needle at the bottom of its reciprocation. The clip 18 of the looper is flexed laterally by the needle upon entry of the bills into the loop. Upon withdrawal of the needle, the loop is normally maintained on the lower bill 16 and is subsequently severed by the knife 20 as the material 12 advances in the direction indicated by the arrow 26 to form a high cut pile. Where a low cut pile is to be formed, the pattern control mechanism (not shown) pulls upon the yarn 11 during withdrawal of the needle, causing the loop to slip past the retaining clip 18 and onto the upper bill 17. The resulting shortened loop is then severed by the knife 21.

The knife block 24 of the present invention comprises a generally rectangular solid body member having generally rectangular, parallel opposite ends 28, 29 and defining a longitudinal direction from end to end. Further, the body member has generally rectangular, parallel, opposite edge faces 31, 32 which define a lateral direction from edge face to edge face, and generally rectangular, parallel, opposite side faces 34, 35 which define a transverse direction from side face to side face.

Each side face 34, 35 includes a pair of laterally spaced apart and laterally aligned channels 36, 37, with each channel extending the full longitudinal length of the body member and communicating with both ends. The channels 36, 37 are parallel to each other in the longitudinal direction, and each has a generally T-shaped cross-sectional configuration to define a pair of opposing lips 39, 40 overlying the edges of the channel. Also, each of the channels 36, 37 on the side face 34 of the body member is transversely aligned with one of the channels 36*a*, 37*a* on the opposite side face 35 to define a forward set of transversely aligned channels 36 and 36*a*, and a rear set of transversely aligned channels 37 and 37*a*.

The knife block 24 further comprises means for releasably securing a knife in each of the four channels. This securing means comprises a first pair of longitudinally spaced apart slots 41, 42 extending laterally into the edge face 31, and a second pair of longitudinally spaced apart slots 43, 44 extending laterally into the edge face 32, with each slot of each pair extending into communication with each channel of the adjacent set of channels. A threaded bore 46 extends laterally into the edge face 31 intermediate the pair of slots 41, 42, and a non-threaded bore 47 extends laterally through the body member and intermediate the other pair of slots 43, 44. Since the pairs of slots are longitudinally offset with respect to each other (note FIG. 1), the two bores 46, 47 are correspondingly spaced from each other in the longitudinal direction.

The knife securing means further comprises first and second U-shaped brackets 50 and 51, respectively, with each bracket including a pair of spaced apart legs 52 and an intermediate segment 54 interconnecting the legs. The legs of the first bracket 50 are adapted to enter the first pair of slots 41, 42, and the legs of the second bracket 51 are adapted to enter the second pair of slots 43, 44, note FIG. 1. The first bracket 50 includes a non-threaded opening 56 extending through the intermediate segment thereof, and the second bracket 51 includes a threaded opening 58 extending through its intermediate segment. A first stud 60 extends freely through the non-threaded opening 56 of the first bracket 50 and operatively engages the threaded bore 46, and a second stud 61 extends freely through the non-threaded bore 47 and operatively engages the threaded opening 58 of the second bracket 51. By this arrangement, the legs of the first bracket 50 are adapted to concurrently engage at spaced points each of two knives 20, 20*a* which are positioned in the forward set of transversely aligned channels 36, 36*a*, and the legs of the second bracket 51 are adapted to similarly engage the knives 21, 21*a*, in the rear set of channels 37, 37*a*. Also, the above arrangement serves to releasably and independently mount the two knives of each laterally aligned pair (i.e., pair 20 and 21, and pair 20*a* and 21*a*) on the block.

Means are also provided for mounting the knife block 24 to the knife bar 25 in a predetermined angular relation. In this regard, the block further includes a laterally extending cylindrical shaft 62 connected to the edge face 32. Also, the knife bar includes a front surface 64 having a plurality of closely spaced vertically directed channels 65 extending along the length thereof. Each of these channels has a generally U-shaped cross-sectional outline which is adapted to closely receive the edge face 32 of the block therein. Also, a cylindrical opening 66 extends laterally through the bar 25 and communicates with each channel 65, and a threaded aperture 68 extends longitudinally into the bar and communicates at substantially right angles with each opening 66. A threaded locking screw 70 is adapted to be threadedly received in the aperture 68. By this arrangement, each block 24 of the tufting machine may be mounted to the bar 25 in a fixed angular relation by inserting the shaft 62 into the opening 66 and positioning the block immediately adjacent the surface 64 of the bar such that the edge face 32 is received within the associated channel 65. The locking screw 70 is then rotated into engagement with the shaft 62 to maintain the interconnection.

Figure 3:
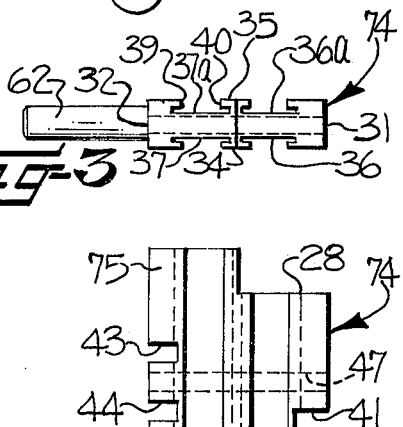
FIG. 3 is a top plan view of a second embodiment of a knife block embodying the present invention.
Figure 4:
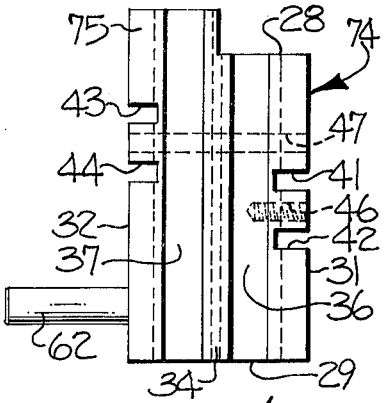
FIG. 4 is a side elevation view of the knife block shown in FIG. 3.

A second embodiment of a knife block which incorporates the features of the present invention is illustrated generally at 74 in FIGS. 3 and 4. In the block 74, the rear portion of the upper end includes an extension 75, such that the rear set of channels 37, 37*a* extend above the forward set of channels 36, 36*a*. Thus, the length of the nonsupported upper portion of the knives 21, 21*a* in the rear set of channels will generally correspond to the length of the nonsupported upper portion of the knives 20, 20*a* in the forward set of channels, and accordingly, the lateral flexibility of all the knives in the block will be approximately the same. The block 74 otherwise corresponds to the above described structure of the block 24.

From the above description, it will be apparent that the present invention provides a novel knife block for mounting a plurality of pairs of knives in a cut pile tufting machine, with each pair being aligned in the machine direction, and wherein the two knives associated with each looper are independently and releasably secured to the block to permit independent removal and replacement thereof. Also, the two knives associated with each looper are laterally spaced apart and separately held in the two channels to permit independent flexure of the knives and thereby assure a proper cutting action by each knife. Further, the overlying lips 39, 40 of the channels serve to prevent each knife from bowing outwardly, and the knives are securely held in the desired position by the brackets 50, 51.

In the drawings and specification, there has been set forth a preferred embodiment of the invention, and although specific terms are employed, they are used in a generic and descriptive sense only and not for purposes of limitation.

That which is claimed is:

1. A knife block for a cut pile tufting machine having provision for accurately mounting a pair of knives which are adapted to operatively engage a looper in the formation of high-low cut pile fabric or the like, and comprising a solid body member having opposite ends and defining a longitudinal direction from end to end, opposite edge faces and defining a lateral direction from edge face to edge face, and opposite side faces, at least one of said side faces including a pair of laterally spaced apart and longitudinally directed channels, with each channel extending at least a substantial portion of the longitudinal length of said body member and communicating with at least one of said ends, and means for releasably securing a knife in each of said channels, whereby a knife may be secured within each of said pair of channels with the knives being laterally spaced apart so as to be adapted to concurrently engage a single looper in a tufting machine.

2. A knife block as defined in claim 1 wherein said pair of channels are aligned in the lateral direction and are parallel to each other in the longitudinal direction.

3. A knife block as defined in claim 1 wherein said knife securing means comprises a slot extending laterally into each of said edge faces of said body member, with each slot communicating with the adjacent channel, a clamping member adapted to extend laterally into each slot to engage a knife positioned therein, and means for releasably and independently mounting each of said clamping members to said body member so as to be disposed within its associated slot.

4. A knife block as defined in claim 3 wherein each of said channels has a generally T-shaped cross-sectional configuration to define a pair of opposing lips overlying the edges of each channel.

5. The knife block as defined in claim 1 further comprising a laterally extending cylindrical shaft connected at one of said edge faces for mounting said block to a tufting machine knife bar.

6. A knife block for a cut pile tufting machine having provision for accurately mounting a plurality of knives in pairs, with each pair being aligned in the machine direction to operatively engage a looper in the formation of high-low cut pile fabric or the like, and comprising a generally rectangular solid body member having opposite ends and defining a longitudinal direction from end to end, generally rectangular, parallel, opposite edge faces and defining a lateral direction from edge face to edge face, and generally rectangular, parallel, opposite side faces and defining a transverse direction from side face to side face, each of said side faces including a pair of laterally spaced apart and laterally aligned channels, with each channel extending the full longitudinal length of said body member and having a generally T-shaped cross-section, and means for releasably securing a knife in each of said channels, whereby a knife may be secured within each of said channels with the pair of knives on each side of the body member being laterally aligned and spaced apart so as to be adapted to concurrently engage a single looper in a tufting machine.

7. The knife block as defined in claim 6 wherein each of the channels on one side face of the body member is transversely aligned with one of the channels on the opposite side face to define two sets of transversely aligned channels.

8. The knife block is defined in claim 7 wherein said securing means comprises means for concurrently engaging two knives which are positioned in each of the two transversely aligned sets of channels.

9. The knife block as defined in claim 8 wherein said engaging means comprises first means for engaging two knives which are positioned in one set of channels and second independent means for engaging two knives which are positioned in the other set of channels.

10. The knife block as defined in claim 7 wherein said securing means comprises a pair of longitudinally spaced apart slots extending laterally into each of said edge faces, with each slot of each pair extending into communication with each channel of the adjacent set of channels, a pair of U-shaped brackets, each bracket including a pair of spaced apart legs which are adapted to enter one of said pair of slots, and means for releasably mounting each of said brackets to said body member with said legs disposed within the associated slots such that said legs are adapted to engage at spaced points each of two knives positioned in the adjacent set of channels.

11. The knife block as defined in claim 10 wherein each of said brackets further includes an intermediate segment interconnecting said pair of legs, and wherein said pairs of slots are longitudinally offset with respect to each other.

12. The knife block as defined in claim 11 wherein said bracket mounting means comprises a threaded bore extending laterally into one of said edge faces intermediate a first pair of slots, a non-threaded bore extending laterally through said body member and intermediate the other pair of slots, a non-threaded opening extending through said intermediate segment of the bracket associated with said first pair of slots, a threaded opening extending through said intermediate segment of the bracket associated with said other pair of slots, a first stud extending through said non-threaded opening and operatively engaging said threaded bore, and a second stud extending through said non-threaded bore and operatively engaging said threaded opening.

* * * * *